US006792387B2

(12) United States Patent
Harlan

(10) Patent No.: US 6,792,387 B2
(45) Date of Patent: Sep. 14, 2004

(54) WIPER BLADE ASSESSMENT SYSTEM AND A METHOD THEREOF

(75) Inventor: Andrij Harlan, Penfield, NY (US)

(73) Assignee: Rochester Institute of Technology, Rochester, NY (US)

( * ) Notice: Subject to any disclaimer, the term of this patent is extended or adjusted under 35 U.S.C. 154(b) by 0 days.

(21) Appl. No.: 10/192,679

(22) Filed: Jul. 9, 2002

(65) Prior Publication Data

US 2003/0009299 A1 Jan. 9, 2003

Related U.S. Application Data

(60) Provisional application No. 60/303,948, filed on Jul. 9, 2001.

(51) Int. Cl.[7] ..... G03G 21/00

(52) U.S. Cl. ..... 702/182; 702/34; 702/113; 702/116; 702/117; 702/189; 702/185

(58) Field of Search ..... 702/34, 119, 113, 702/117, 189, 185, FOR 114, FOR 110, FOR 124, FOR 135, FOR 134, FOR 170, FOR 171; 700/108, 109, 110; 399/38, 312, 313, 350, 351, 353

(56) References Cited

U.S. PATENT DOCUMENTS

| | | | | | |
|---|---|---|---|---|---|
| 4,937,633 | A | * | 6/1990 | Ewing | 399/34 |
| 4,942,387 | A | * | 7/1990 | Thomas | 340/683 |
| 5,229,817 | A | * | 7/1993 | Lange et al. | 399/34 |
| 5,239,350 | A | * | 8/1993 | Godlove | 399/34 |
| 5,278,620 | A | * | 1/1994 | Godlove | 399/71 |
| 6,226,479 | B1 | * | 5/2001 | Karaki et al. | 399/159 |
| 2002/0021923 | A1 | * | 2/2002 | Sato et al. | 399/350 |

* cited by examiner

*Primary Examiner*—Marc S. Hoff
*Assistant Examiner*—Carol S. W. Tsai
(74) *Attorney, Agent, or Firm*—Nixon Peabody LLP

(57) ABSTRACT

A system for assessing an edge of a wiper blade includes a detector, a transport system, and an evaluation processing system. The detector provides an indication of each identified defect in an edge of the wiper blade. The transport system moves at least one of the detector and the wiper blade along at least a portion of the other. The evaluation processing system is coupled to the detector and obtains an evaluation of the edge of wiper blade based on the indication of each defect from the detector.

12 Claims, 3 Drawing Sheets

WIPER BLADE ASSESSMENT SYSTEM AND A METHOD THEREOF

The present invention claims the benefit of U.S. Provisional Patent Application Serial No. 60/303,948, filed Jul. 9, 2001, which is hereby incorporated by reference in its entirety.

FIELD OF THE INVENTION

This invention relates generally to evaluation systems and methods and, more particularly, to a system and method for evaluating a condition of an edge of a wiper blade.

BACKGROUND OF THE INVENTION

In a copy machine the Organic Photo Conducting ("OPC") drum needs to be wiped completely clean so that there is no residual toner transferred onto the next image in an area that does not require toner. A wiper blade, which is in a constant, normal force, engagement with the OPC drum, is used to wipe or scrape off this non-transferred toner.

One failure mode for this wiper blade is a defect, such as a nick or a void, along an edge of the wiper blade. Although typically these nicks or voids are very minor, they still allow toner to flow by causing defects in the resulting prints. These nicks or voids are also difficult to detect because they usually are not visible to the "naked eye."

High-powered magnification systems could be used to inspect the edge of the wiper blades for defects. Unfortunately, these magnification systems are very costly and the inspection process with them is labor intensive and slow.

The edge of wiper blades could also be inspected by touch or "finger tip feel." Although this process is less expensive then the techniques described above using a magnification system, this process is less reliable in identifying defects. Additionally, the process of touching the edge of the wiper blade to detect defects may create new defects in the edge.

Accordingly, prior techniques for evaluating a wiper blade are either to costly or to unreliable. As a result, it has been difficult to assess the quality of newly manufactured wiper blades as well as the quality of wiper blades that may be reused.

SUMMARY OF THE INVENTION

A system for assessing an edge of a wiper blade in accordance with one embodiment of the present invention includes a detector, a transport system, and an evaluation processing system. The detector provides an indication of each identified defect in an edge of the wiper blade. The transport system moves at least one of the detector and the wiper blade along at least a portion of the other. The evaluation processing system is coupled to the detector and obtains an evaluation of the edge of wiper blade based on the indication of each defect from the detector.

A method for assessing an edge of a wiper blade in accordance with another embodiment of the present invention includes moving at least one of a detector and the wiper blade along at least a portion of the other. An indication of each identified defect in an edge of the wiper blade is obtained during the moving. An evaluation of the edge of wiper blade is obtained based on the indication of each defect from the detector.

The present invention provides an effective system and method for assessing the integrity of a wiper blade. This system and method is cost effective when compared to prior evaluation systems. Additionally, this system and method is reliable in identifying defective wiper blades and will not cause damage to the edge of the wiper blade during evaluation. As a result, with the present invention newly manufactured wiper blades as well as wiper blades which may be reused can be easily and effective evaluated to determine if they are acceptable for use.

DETAILED DESCRIPTION

Figure 1:
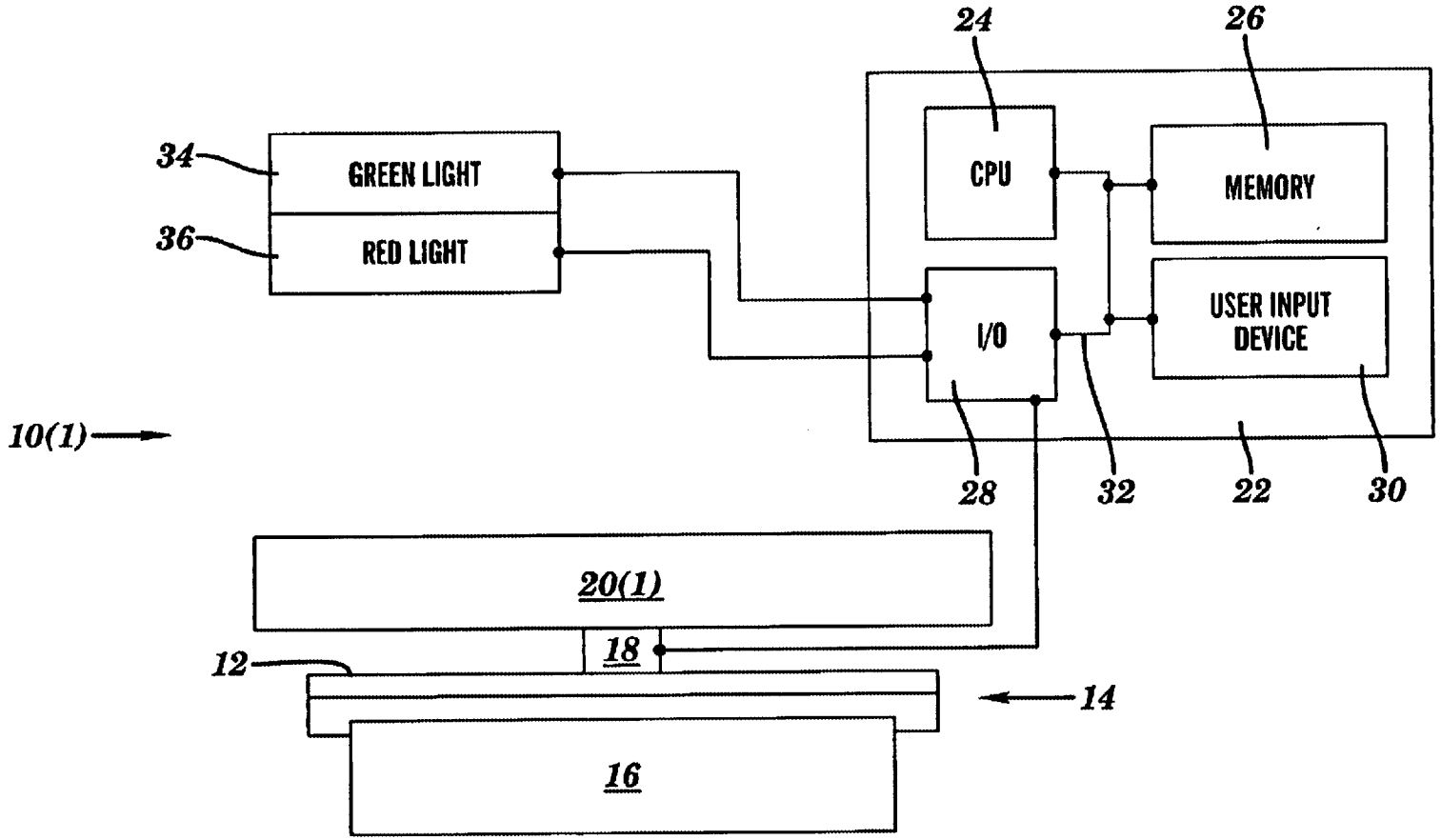
FIG. 1 is a block diagram of a system for assessing an edge of a wiper blade in accordance with one embodiment of the present invention.

A system 10(1) for detecting defects in an edge 12 of a wiper blade 14 in accordance with one embodiment of the present invention is illustrated in FIG. 1. The system 10(1) in accordance with one embodiment includes a retaining block 16, an accelerometer 18, a movable carriage 20(1), and an evaluation processing system 22. The present invention provides a system and method for cost effectively evaluating the integrity of a wiper blade 14.

Referring to FIG. 1, the retaining block 16 includes an elongated recess in which a portion of the wiper blade 14 is secured while an edge 12 of the wiper blade 14 is evaluated. The recess in the retaining block 16 extends along the length of the block and has a width slightly larger then the width of the wiper blade 14. As a result, the portion of the wiper blade 14 fits snugly in and is retained in the recess while the edge 12 of the wiper blade 14 is exposed for inspection and evaluation. Although a retaining block 16 with an elongated recess is shown, other types of securing systems can be used, such as one or more clamps to hold the wiper blade 14 in place.

An accelerometer 18 is used to inspect for and detect any defects in the edge 12 of the wiper blade 14. The accelerometer 18 is brought into contact with the edge 12 of the wiper blade 14. Any defects in the edge 12 of the wiper blade 14 encountered by the accelerometer 18, such as a nick or a void in the edge 12, will result in a detectable vibration by the accelerometer 18. The accelerometer 18 transmits a signal representative of the each vibration and thus of each defect to the evaluation processing system 22. Although an accelerometer 18 is shown, other types of detectors can be used.

A movable carriage 20(1) is connected to and moves the accelerometer 18 along the edge 12 of the wiper blade 14. The movable carriage 20(1) includes a ball slide, pneumatic carriage return, a Bimba air cylinder, mounting brackets, and proximity switches. Since the connections of these components and their operation to form a moveable carriage 20(1) are well known, they will not be discussed here. Although a movable carriage 20(1) is shown, other types of transport systems for moving the accelerometer 18 and/or the wiper blade 14 can be used. Additionally, although in this particular embodiment the accelerometer 18 moves along the edge 12 of the wiper blade 14 other arrangements are possible, such as moving the edge 12 of the wiper blade 14 with respect to the accelerometer 18 with a movable carriage 20(2) while the accelerometer 18 is held in place as shown FIG. 2 or moving both the accelerometer 18 and the wiper blade 14 with respect to each other.

Figure 2:
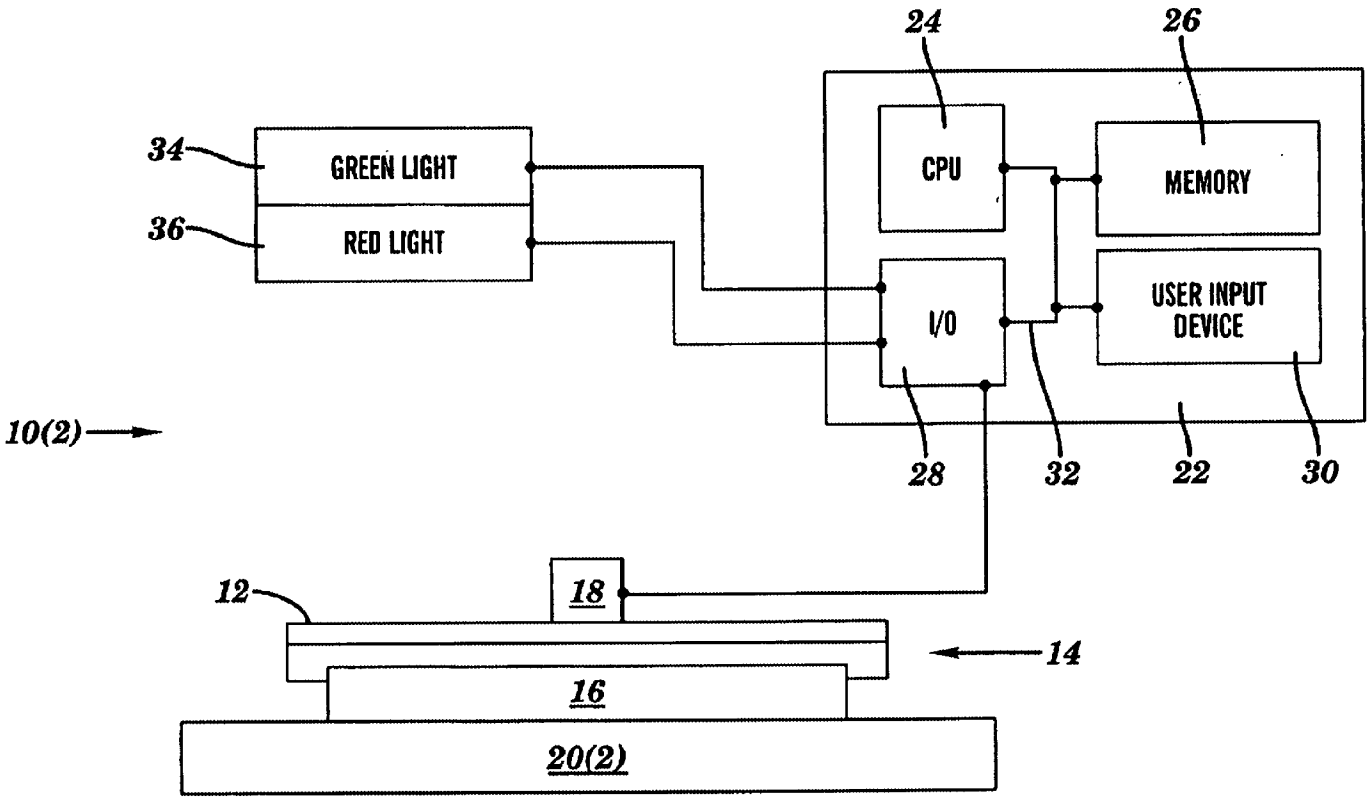
FIG. 2 is a block diagram of another system for assessing an edge of a wiper blade in accordance with another embodiment of the present invention.

Referring to FIG. 2, another system 10(2) for detecting defects in an edge 12 of a wiper blade 14 is illustrated in FIG. 2. The system 10(2) in FIG. 2 is identical to the system 10(1) shown in FIG. 1, except as described and illustrated herein. Elements in FIG. 2 which are the same as those shown in FIG. 1 have like reference numerals. In this embodiment, the movable carriage 20(2) is connected to the wiper blade 14 instead of to the accelerometer 18. The accelerometer 18 is held in place while the movable carriage 20(2) moves the edge 12 of the wiper blade 14 along the accelerometer 18 to provide an indication of any defects in the edge 12 of the wiper blade 14.

Referring back to FIG. 1, an evaluation processing system 22 is coupled to the accelerometer 18. The evaluation processing system 22 includes a central processing unit (CPU) 24, a memory 26, an input/output ("I/O") interface 28, and a user input device 30 which are coupled together by a bus system 32 or other link, although the evaluation processing system 22 may comprise other components, other numbers of the components, and other combinations of the components. The processor or CPU 24 executes a program of stored instructions for the method for assessing a wiper blade 14 in accordance with the present invention as described herein and illustrated in FIG. 2. In this particular embodiment, those programmed instructions are stored in memory 26, although some or all could be stored and retrieved from other locations. A variety of different types of memory storage devices, such as a random access memory (RAM) or a read only memory (ROM) in the system or a floppy disk, hard disk, CD ROM, or other computer readable medium which is read from and/or written to by a magnetic, optical, or other reading and/or writing system that is coupled to the processor, can be used for memory 26. The I/O interface 28 is used to operatively couple and communicate between the evaluation processing system 22, the accelerometer 18, and the green and red lights 34 and 36, although the I/O interface could be used to couple and communicate with other elements. A variety of different types of connections and communication techniques can be used to transmit signals between the evaluation processing system 22 and accelerometer 18 and/or green and red lights 34 and 36. The user input device enables an operator to generate and transmit signals or commands to the processor, such as new error tolerances or parameters for defects in the edge 12 of the wiper blade 14. A variety of different types of user input devices can be used, such as a keyboard or computer mouse.

A green light 34 and a red light 36 are coupled to the evaluation processing system 22. The green light 34 is turned on by the evaluation processing system 22 when the evaluation of the edge 12 of wiper blade 14 indicates that the wiper blade 14 is in an acceptable condition. The red light 36 is turned on by the evaluation processing system 22 when the evaluation of the edge 12 of wiper blade 14 indicates that the wiper blade 14 is defective or unacceptable. Although green and red lights 34 and 36 are shown, other types of indication systems, such as a computer display, printout, or sound system, can be used.

Figure 3:
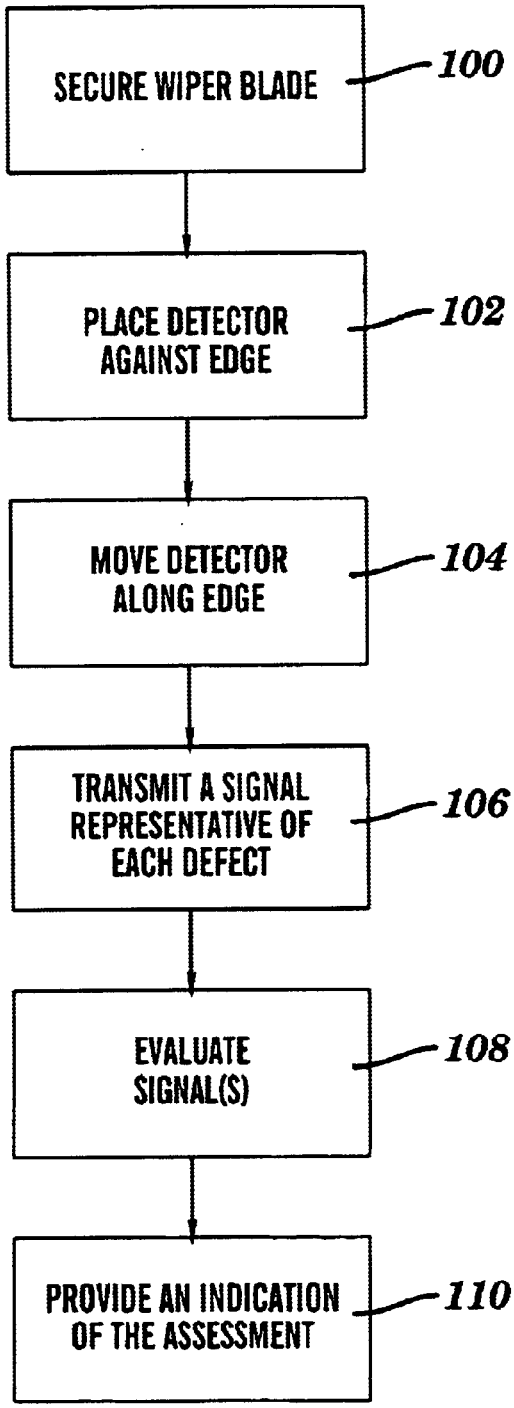
FIG. 3 is a flow chart of a method for assessing an edge of a wiper blade in accordance with another embodiment of the present invention.

A method for assessing a wiper blade 14 will be described with reference to FIGS. 1 and 3. In step 100, the portion of the wiper blade 14 is secured in the recess in the retaining block 16 so that the edge 12 is exposed for inspection and evaluation, although other methods for securing the wiper blade 14 can be used.

In step 102, the accelerometer 18 is placed against the edge 12 of the wiper blade 14, although other types of detectors can be used.

In step 104, the accelerometer 18 is moved along the edge 12 of the wiper blade 14 by the motion system, although other arrangements could be used. If the accelerometer 18 encounters a defect, such as a nick or void in the edge 12 of the wiper blade 14, the defect will result in a detectable vibration by the accelerometer 18.

In step 106, a signal representative of each defect is transmitted by the accelerometer 18 to the evaluation processing system 22.

In step 108, the evaluation processing system 22 evaluates the signal or signals received from the accelerometer 18 or the absence of any received signals from the accelerometer 18 during testing to obtain an assessment of the condition of the edge of the wiper blade 14. The evaluation processing system 22 compares each signal received against a threshold value or parameter stored in memory for the type of wiper blade 14 being evaluated. If any of the received signals is above the threshold value or parameter, then the evaluation processing system 22 determines that the wiper blade 14 is defective. If none of the received signals is above the threshold value or parameter or no signals are received during the assessment of the wiper blade 14, then the evaluation processing system 22 determines that the wiper blade 14 is in an acceptable condition. Although one method for evaluating the wiper blade 14 is disclosed, other methods can be used, such as basing the evaluation on image quality.

In step 110, based on the evaluation of the wiper blade 14 the evaluation processing system 22 provides an indication of the assessment by turning on either a green light 34 or a red light 36. If the evaluation processing system 22 has determined that the wiper blade 14 is in an acceptable condition, then the evaluation processing system 22 would send a signal to turn on the green light 34. If the evaluation processing system 22 has determined that the wiper blade 14 is defective, then the evaluation processing system 22 would send a signal to turn on the red light 36. Although green and red lights 34 and 36 are shown, other types of indication systems for signaling the evaluation of the wiper blade 14, such as an indication of the assessment of the wiper blade 14 on a display, can also be used.

The operation of the system 10(1) for assessing a wiper blade 14 shown in FIG. 2 is the same as described above for the system 10(1) shown in FIG. 1, except that in step 104, the accelerometer 18 is held in place and the edge 12 of the wiper blade 14 is moved along the accelerometer 18.

Accordingly, the present invention provides a system and method for assessing the integrity of a wiper blade 14 which is easy to use and effective. The system and method are reliable in identifying defective wiper blades and will not cause damage to the edge 12 of the wiper blade 14 during the evaluation process. As a result, the present invention can be used for the evaluation of newly manufactured wiper blades as well as for a verification device for wiper blades for reuse.

Having thus described the basic concept of the invention, it will be rather apparent to those skilled in the art that the foregoing detailed disclosure is intended to be presented by way of example only, and is not limiting. Various alterations, improvements, and modifications will occur and are intended to those skilled in the art, though not expressly stated herein. These alterations, improvements, and modifications are intended to be suggested hereby, and are within the spirit and scope of the invention. Additionally, the recited order of processing elements or sequences, or the use of numbers, letters, or other designations therefor, is not intended to limit the claimed processes to any order except as may be specified in the claims. Accordingly, the invention is limited only by the following claims and equivalents thereto.

What is claimed is:

1. A system for assessing a wiper blade, the system comprising:

a detector that provides an indication of each identified defect in an edge of the wiper blade;

a transport system that moves at least one of the detector and the wiper blade along at least a portion of the other; and an evaluation processing system coupled to the detector, the evaluation processing system obtaining an evaluation of the edge of the wiper blade based on the indication of each defect from the detector.

2. The system as set forth in claim 1 further comprising a securing system for holding the wiper blade for evaluation.

3. The system as set forth in claim 1 further comprising an indication system coupled to the evaluation processing system, the indication system providing a signal representative of the evaluation of the edge of the wiper blade by the evaluation processing system.

4. The system as set forth in claim 1 wherein the detector is an accelerometer.

5. The system as set forth in claim 1 wherein the transport system moves the detector along the edge of the wiper blade.

6. The system as set forth in claim 1 wherein the transport system moves the edge of the wiper blade along the detector.

7. A method for assessing a wiper blade, the method comprising:

moving at least one of a detector and the wiper blade along at least a portion of the other;

providing an indication of each identified defect in an edge of the wiper blade during the moving;

obtaining an evaluation of the edge of the wiper blade based on the indication of each defect from the detector.

8. The method as set forth in claim 7 further comprising holding the wiper blade for evaluation.

9. The method as set forth in claim 7 further comprising providing a signal which represents the obtained evaluation of the edge of the wiper blade.

10. The method as set forth in claim 7 wherein the detector is an accelerometer.

11. The method as set forth in claim 7 wherein the moving further comprises moving the detector along the edge of the wiper blade.

12. The method as set forth in claim 7 wherein the moving further comprises moving the edge of the wiper blade along the detector.

* * * * *